US006684035B2

(12) United States Patent
Furno et al.

(10) Patent No.: US 6,684,035 B2
(45) Date of Patent: Jan. 27, 2004

(54) ADJUSTABLE AUTOMATIC PROCESS CONTROL DENSITY PATCH LOCATION DETECTION

(75) Inventors: Joseph J. Furno, Rochester, NY (US); R. Scott Lockhart, Webster, NY (US)

(73) Assignee: NexPress Solutions LLC, Rochester, NY (US)

( * ) Notice: Subject to any disclaimer, the term of this patent is extended or adjusted under 35 U.S.C. 154(b) by 23 days.

(21) Appl. No.: 10/174,600

(22) Filed: Jun. 19, 2002

(65) Prior Publication Data

US 2003/0235418 A1 Dec. 25, 2003

(51) Int. Cl.[7] ..... G03G 15/00
(52) U.S. Cl. ..... 399/49; 399/72
(58) Field of Search ..... 399/49, 72, 60, 399/165, 301; 324/71.1, 452; 347/116

(56) References Cited

U.S. PATENT DOCUMENTS 5,410,388 A * 4/1995 Pacer et al. ..... 399/49
5,652,946 A * 7/1997 Scheuer et al. ..... 399/49
5,784,667 A * 7/1998 Mestha et al. ..... 399/49
5,903,796 A * 5/1999 Budnik et al. ..... 399/26
5,953,555 A 9/1999 Budnik ..... 399/49
6,044,234 A * 3/2000 Yoshizawa ..... 399/49
6,385,408 B1 * 5/2002 Scheuer ..... 399/49
6,434,346 B1 * 8/2002 Knott et al. ..... 399/49

FOREIGN PATENT DOCUMENTS

JP 05145753 A * 6/1993 ..... H04N/1/40

* cited by examiner

*Primary Examiner*—Robert Beatty

(57) ABSTRACT

A method and structure that tests a process control patch in an electrophotographic printer by observing/creating a beginning recording medium lead edge location, which establishes a references point on a transportation device. Next, the invention tracks the position of the transport mechanism within the printer by starting a counter triggered by the medium lead edge signal or a virtual medium lead edge signal. The invention then prints the process control patch on the transportation device. The invention identifies positions of the transportation device and process control patch locations once the process control patch passes through a densitometer sensor. The invention establishes a patch testing area determined by a calculated patch trigger point and user configurable sample window parameters. The difference between the threshold-detected leading edge and trailing edge represents the width of the process control patch. The invention tests the calculated patch width for accuracy.

19 Claims, 2 Drawing Sheets

ADJUSTABLE AUTOMATIC PROCESS CONTROL DENSITY PATCH LOCATION DETECTION

BACKGROUND OF THE INVENTION

1. Field of the Invention

The present invention relates in general to an electrophotographic printing system and more particularly to an improved electrophotographic printing system that ensures that the center of a calibration patch is evaluated.

2. Description of the Related Art

An electrophotographic printing system needs to continually regulate the toning density of the imaging subsystem by periodically reading image density and adjusting various imaging parameters to maintain the desired image density. The imaging subsystem can be adjusted by attempting to print a uniformly toned patch (or target) onto the sheet transport mechanism and then reading the density of the printed patch with a densitometer. In order to accurately read the patch, the patch position on the transport mechanism must be accurately tracked from the point of it being printed onto the transport mechanism to the point of it being read by the densitometer sensor. The imaging subsystem can determine the appropriate place to read the patch by estimating the distance between these two points but, due to mechanical differences between systems, this distance must be accurately determined through calibration. One way of performing this is to have the print engine automatically locate the position of the process control density patch using the densitometer by taking periodic density reading samples while the sheet transport mechanism moves the patch through the sensor.

One such method that addresses this problem is disclosed in U.S. Pat. No. 5,953,555 dated Sep. 14, 1999, which is incorporated herein by reference. The key point of the design in U.S. Pat. No. 5,953,555 is that the area of the process control patch is calculated from the sampled density patch waveform and the patch positional centerline is calculated and compared to a predetermined positional centerline. The difference/delta between the patch centerline and the predetermined centerline is used as an automatic timing or position adjustment for subsequent patch readings used for toning density regulation. This design requires a solid uniform patch to be printed. If the uniformity is inconsistent, the calculated centerline of the patch may not be accurate.

The invention described below overcomes the problems of the conventional system by providing a system that locates a trigger point or offset within the calibration patch and limits the evaluation to areas in the center section of the patch.

SUMMARY OF THE INVENTION

In view of the foregoing and other problems, disadvantages, and drawbacks of the conventional printing system, the present invention has been devised, and it is an object of the present invention, to provide a structure and method for an adjustable automatic process control density patch location detection.

In order to attain the object suggested above, there is provided, according to one aspect of the invention, a method of testing a process control patch in an electrophotographic printer. The invention first observes/creates a beginning transport medium lead edge location, which establishes a reference point on a transportation device. Next, the invention tracks the position of the transport mechanism within the printer by starting a counter triggered by the medium lead edge sensor or by a created virtual medium lead edge signal that is internally machine generated. The invention then prints the process control patch on the transportation device. The invention identifies positions of the transportation device and process control patch locations once the process control patch passes through a densitometer sensor. The invention measures the width of the patch against a predetermined patch width and tests the measured width for accuracy. The invention establishes a patch testing area determined by a calculated patch trigger point and user configurable sample window parameters. The difference between the leading edge and the trailing edge represents the width of the process control patch. The patch testing area is smaller than the width of the process control patch. The invention later evaluates the print image density of the patch testing area using the sensor during normal print operations and other calibration routines.

The invention tracks the position of the lead edge location or reference point through the use of a counter that is started upon the generation of the lead edge signal. The patch testing area omits testing (or sampling) points of the process control patch that are outside of the area defined by the beginning patch trigger point and the user configurable sample window parameters. The size of the patch testing area and number of samples taken within the patch testing area are user-adjustable. The invention records the beginning patch trigger point.

In another embodiment, the invention samples a process control patch in an electrophotographic printer by first printing a process control patch on a print medium transportation device, defining a patch testing area within the process control patch (such that the patch testing area is smaller than the process control patch), and determining printing density in the patch testing area.

The invention defines the patch testing area by identifying the process control patch on the print medium transportation device and monitoring movement of the print medium transportation device. The process of determining the printing density is restricted to the patch testing area based on the monitoring of the movement of the print medium transportation device. The patch testing area is bounded by the user configurable sample window parameters. The patch testing area is determined by sensing the media leading edge location on the print medium transportation device and monitoring the movement of the print medium transportation device to locate the patch testing area at a predetermined distance from the media leading edge. The density within the patch testing area is determined by testing using densitometers, to determine density of printing.

The invention also provides a system for sampling a process control patch in an electrophotographic printer. The system includes a print medium transportation device and a printing element adjacent the print medium transportation device. The printing element prints the process control patch on the print medium transportation device. The system further includes a counting mechanism attached to the print medium transportation device. The counting mechanism defines a patch testing area within process control patch such that the patch testing area is smaller than the process control patch. Also, the system includes a densitometer adjacent the print medium transportation device. The densitometer determines the printing density in the patch testing area.

The counter defines the patch testing area and monitors movement of the print medium transportation device. In normal operation, the densitometer locates the patch testing area based upon a count of the counter. In calibration mode, the densitometer is used to locate the process control patch and the position of where the process control patch was found on the print medium transportation device is recorded, based on the count of the counter when the process control patch was identified by the densitometer.

The system also includes a print medium leading edge sensor that senses the initial media edge (real or virtual) on the print medium transportation device for triggering the start of a process control patch reading cycle. The counter locates the patch testing area at a predetermined distance from the print medium leading edge, and is used together with the user configurable sample window parameters for sampling the print density.

As mentioned above, in calibration mode, the densitometer, in conjunction with output from the counter, determines printing density to identify a position of leading and trailing edges of the process control patch on the print medium transportation device. The counter is used to calculate a patch trigger point for the patch testing area based on a user definable trigger point. The user definable trigger point identifies the distance for a beginning patch trigger point of the patch testing area from the leading edge of the process control patch. Preferably, the beginning patch trigger point and user configurable sample window provide a patch test area that is centered within the process control density patch.

BRIEF DESCRIPTION OF THE DRAWINGS

The foregoing and other objects, aspects and advantages will be better understood from the following detailed description of a preferred embodiment(s) of the invention with reference to the drawings, in which.

DETAILED DESCRIPTION OF PREFERRED EMBODIMENTS OF THE INVENTION

The invention provides a method that locates and takes samples from the center section of the process control patch to overcome the problems with the conventional systems. More specifically, in order to accurately read and measure the density of the process control patch, several densitometer sensor readings of the patch are read and averaged.

The inventors have found that these samples are the most stable around the center section of the patch. For this situation, the inventive Adjustable Automatic Process Control Density Patch Location Detection will determine the desired trigger point (e.g., quarter point) within the patch to allow evenly spaced densitometer sample readings through the center section of the patch that yield the most stable values.

The invention calculates the new patch location used in subsequent process control patch readings using an electrophotographic printing system by printing a maximum density patch and over-sampling this patch to determine its location. In addition, the invention provides a region definition (sample window) that is user-adjustable to provide flexibility to accommodate a wide variety of needs. More specifically, due to various effects in the system, it may be desirable to sample a larger region or smaller region to filter out any density noises/spikes, to avoid transition effects, or to accommodate for different patch sizes. Therefore, the patch trigger point is a user-configurable parameter and can be modified to automatically adjust the patch read timing/position.

Figure 1:
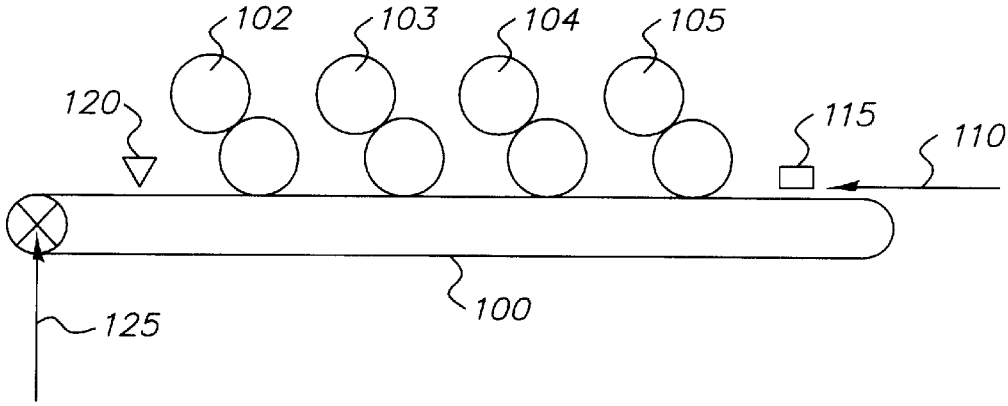
FIG. 1 is a schematic diagram of an electrophotographic printing system.

As shown in FIG. 1, the printing of the maximum density patch on the Web Transport 100 is started by the assertion of the lead edge timing signal noted by leading edge indicator unit 115. This lead edge timing signal identifies the leading edge of the recording medium 110 (e.g., paper Lead Edge Signal). The lead edge timing signal triggers counters that control the timing of each electrophotographic module 102–105 to print a process control density patch at the same place on the Web Transport 100. For example, the patch could comprise a 12 mm×12 mm black square that is printed on the Web Transport 100 directly after (following) a piece of recording medium.

The invention locates a process control patch during a calibration cycle and calculates a beginning patch trigger point used to establish a testing area within the center section of the patch. This patch testing area will be utilized during normal printing conditions in which an actual recording medium 110 is undergoing actual printing. However, during the calibration cycle, no paper is transported along the Web Transport. Instead, the invention utilizes a virtual piece of recording medium and creates a simulated lead edge trigger signal. In other words, the invention pretends that a recording medium is traveling on the Web Transport 100 and leaves appropriate spacing (Patch Search Trigger Distance) to accommodate for the virtual piece of recording medium. The calibration cycle can be run as often as necessary (whenever the printer is started, once a month, day, hour, etc.).

The example in FIG. 1 is a schematic diagram of the placement of the lead edge indicator unit 115 with respect to the electrophotographic modules 102–105 and densitometer sensors 120 in a four color electrophotographic printing system. However, the foregoing is merely an exemplary system used to demonstrate the advantages of the invention and the invention is not limited to the specific structure shown in FIG. 1. To the contrary, the invention is applicable to all printing systems that use any form of process control patch.

The lead edge timing signal is generated by unit 115 when it senses the leading edge of a piece of recording medium and starts a counter that monitors the position (timing) of where (when) the densitometer sensor 120 should begin sampling the Web Transport 100 to find the patch. Therefore, the leading edge unit 115 establishes a starting location (e.g., a reference point) on the Web Transport 100. In other words, the lead edge unit 115 "zero's out" the counter that is counting encoder pulses generated by the Web Encoder 125 at the leading edge of a piece of recording medium 110. This reference point represents the leading edge of a sheet of recording medium in normal operation, or in calibration mode, would represent the leading edge of a virtual piece of recording medium.

The Web Encoder 125 determines the exact distance traveled by the transport mechanism 100 (e.g., web transporter) and position of the Web Transport 100 (and the calibration patch thereon). The counter value where the patch should be located when tested is identified and stored in a non-volatile memory as the test area. The timing of the individual densitometer sensor readings are "timed" using a high precision transport mechanism encoder 125 that counts the movement (rotation, linear movement, etc.) of devices within the printing system and thus are not effected by any speed fluctuations in the transport, unlike a true clock-based timer. For example, the encoder 125 could count rotations, count periodic permanent markers on the underside of the Web Transport 100, or use any other systems/methods for observing movement of devices within the printing system.

Figure 2:
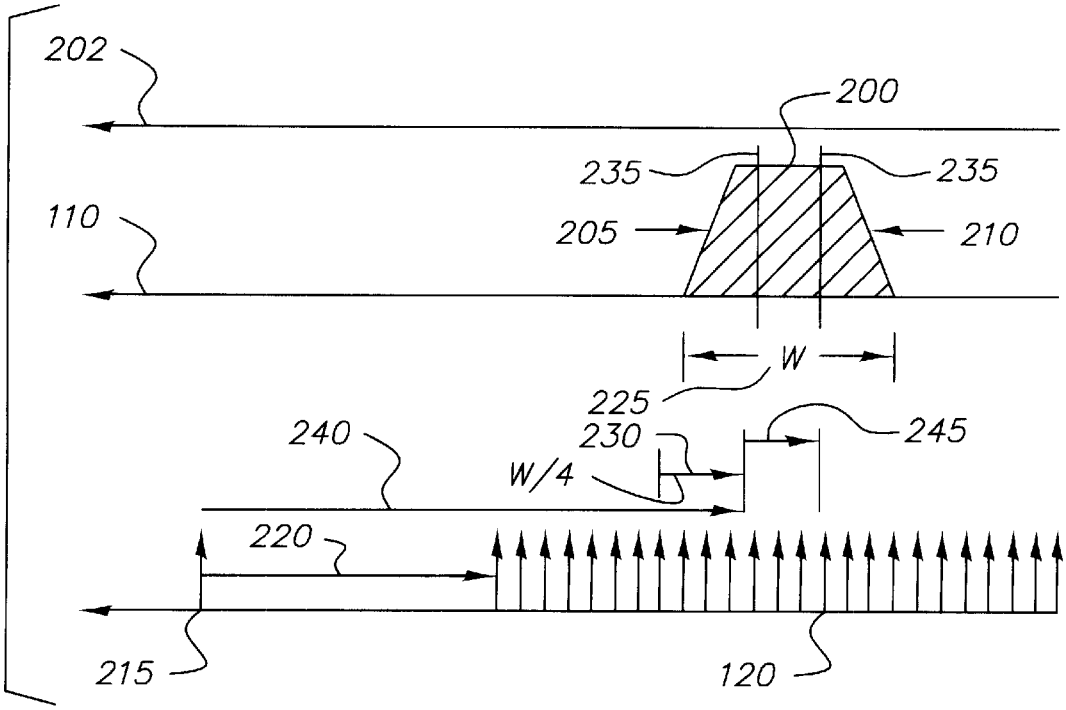
FIG. 2 is a schematic diagram illustrating how the invention locates a process control patch and calculates a beginning patch trigger position.

As shown in FIG. 2, the patch start/lead edge 215 represents the leading edge of the virtual recording medium 110 (the zero count position along the web transport as established by the lead edge unit 115). In this example, the recording medium 110 is traveling in the Web Transport direction 202 indicated by the arrow in FIG. 2. The Patch Search Trigger Distance (PSTD) 220 represents the distance traveled between the leading edge/reference point of the (virtual) recording medium 215 and the location where the patch 200 is expected to be located when it passes beneath the densitometer sensor.

The density patch is then over-sampled by the densitometer 120 to ensure that the entire patch has been captured. A threshold detection scheme is then applied to the results of the over-sampling to determine the Patch Lead Edge (PLE) 205 and Patch Trail Edge (PTE) 210 points, as shown in FIG. 2.

A Patch Trigger Point (PTP) 230, which is the desired position to start process control density readings, is then calculated. The PTP will be used in normal operating conditions to verify that the printer is creating the desired density patch. This portion of the invention is primarily concerned with setting the PTP during a calibration cycle.

The PTP 230 is calculated using the detected Patch Leading Edge 205 and two parameters, which can be adjusted by the user/operator: the predetermined patch width (W) 225 and patch trigger point divider (PTPD). The PTPD, in conjunction with the patch width, defines an offset into the patch that is used to read the center section of the patch. For example, the PTP 230 could be calculated to be the quarter point location of the patch (i.e., PTPD=4, so the PTP starts at W/4). The area immediately after the quarter point location 235 is the patch testing area. Thus, in this example, the samples 120 from the middle half of the patch will be analyzed, while the beginning quarter and ending quarter of the patch will be omitted from analysis. The number of samples taken within the testing area is independent of the Patch Trigger Point Divider. Therefore, the invention gives a user/operator the option to modify the PTPD to move the "starting point" of the patch sampling region (e.g., ⅓, ⅕, ⅙, ⅛, etc).

Figure 3:
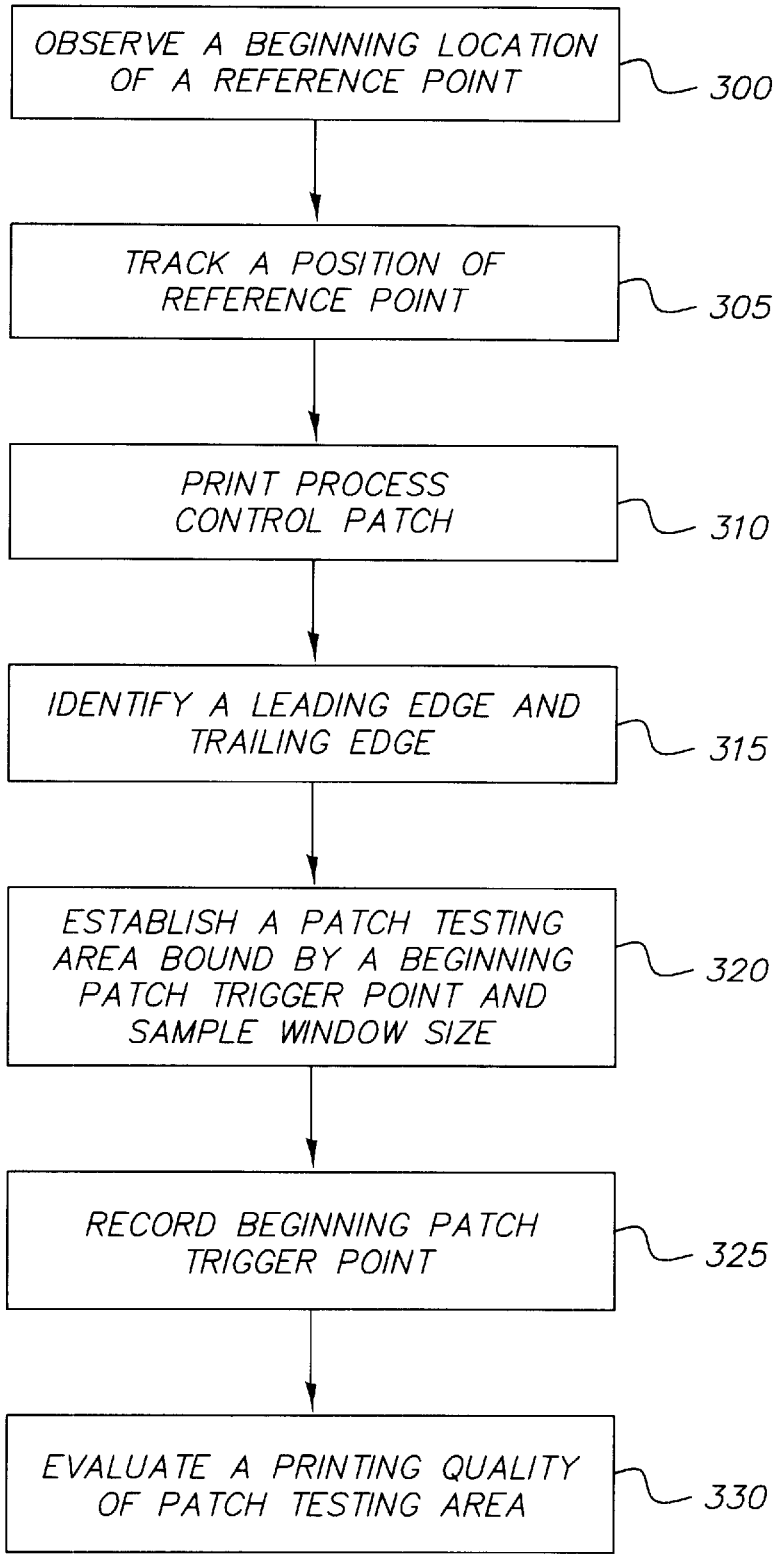
FIG. 3 is a flowchart illustrating the processing taken with the invention.

FIG. 3 is a flowchart that illustrates the process of the invention. In item 300, the invention observes a beginning location of a reference point. Next, in item 305, the invention tracks the position of the reference point as the Web Transport moves. In item 310, the invention prints the process control patch on the Web Transport. In item 315, the invention identifies a leading edge and a trailing edge of the patch using densitometers. Then, in item 320, the invention establishes a patch testing area defined by the patch trigger point and the user configurable sample window parameters. In item 325, the invention records the patch trigger point. Lastly, in item 330, the invention evaluates the print image density of the patch testing area. The invention omits samples from the very beginning and very end of the patch in order to prevent samples from being used in the less stable areas of the process control patch.

Once the PTP has been calculated, the final calculation for the new test area to be used in actual printing operations can be performed using the PSTD 220, PLE 205, and PTPs 230. This is known at the Patch Trigger Count (PTC). (PTC= PSTD+PLE+PTP). The PTC is saved in non-volatile memory and used later for finding the patches while performing process control adjustments. Once the test area has been established using a virtual piece of recording medium in a calibration cycle, the patch is tested during printing operations when an actual piece of recording medium is printed. As shown above, the invention analyzes only the interior portion of the patch to verify the proper operation of the printer. If the patch fails the verification process (e.g., falls outside predetermined quality specifications), this indicates a failure, requiring maintenance of the electrophotographic printer. This invention provides the ability to select the "sweet-spot" within any control measurement where the target has a center section that is more stable that the edges. This invention also provides the flexibility to use various size patches and provides immunity to non-uniform patches.

While the invention has been described in terms of preferred embodiments, those skilled in the art will recognize that the invention can be practiced with modification within the spirit and scope of the appended claims.

PARTS LIST

Item Description
100 media transport web
102 electrophotographic modules
103 electrophotographic modules
104 electrophotographic modules
105 electrophotographic modules
110 recording medium
115 recording medium lead edge sensor unit
120 densitometer sensors
125 web encoder
200 patch
202 web transport direction
205 Patch Lead Edge (PLE)
210 Patch Trail Edge (PTE)
215 lead edge signal/reference point
220 Patch Search Trigger Distance (PSTD)
225 patch width (predetermined)
230 Patch Trigger Point (PTP)
235 quarter point locations
240 Patch Trigger Count (PTC)
245 user configurable sample window

What is claimed is:

1. A method of establishing sampling parameters of a process control patch in an electrophotographic printer, said method comprising:

determining a beginning lead edge location of a reference point on a transportation device;

tracking a position of said reference point on said transport device within said printer by starting a counter triggered by a recording medium lead edge sensor or created virtual medium lead edge signal;

printing said process control patch on said transportation device;

identifying positions of said transportation device and said process control patch locations once said process control patch passes through a densitometer sensor; and establishing a patch testing area determined by a calculated patch trigger point and user configurable sample window parameters, wherein a difference between a leading edge and a trailing edge of said patch represents a width of said process control patch, and wherein said patch testing area is smaller than said width of said process control patch.

2. The method in claim 1, wherein said tracking bases said position of said reference point on said transport device upon starting a counter triggered by said lead edge signal or virtual lead edge signal.

3. The method in claim 1, wherein said patch testing area omits testing points of said process control patch that are outside of the area determined by the beginning patch trigger point and the user configurable sample window.

4. The method in claim 1, wherein a size of said patch testing area is user-adjustable.

5. The method in claim 1, wherein a size of said patch is measured against a predetermined patch width and tested for accuracy.

6. The method in claim 1, further comprising recording said beginning patch trigger point for future testing of said printer.

7. A method of establishing sampling parameters of a process control patch in an electrophotographic printer, said method comprising:

identifying positions of a transportation device when said process control patch passes by a sensor; and establishing a patch testing area based on results of the identifying step, comparing a difference between a leading edge and a trailing edge which represents a width of said process control patch against a predetermined patch width for accuracy, and wherein said patch testing area is smaller than said width of said process control patch.

8. The method in claim 7, further comprising before the step of establishing a step of observing a beginning location of a reference point on said transportation device.

9. The method in claim 8, further comprising a step of tracking a position of said reference point within said printer, based on said beginning location and a counter.

10. The method in claim 9, wherein the step of tracking bases said position of said reference point upon a difference between said beginning location and a count on said counter.

11. The method in claim 7, wherein the step of establishing further comprises said patch testing area omitting test points of said process control patch that are outside of an area determined by a beginning patch trigger point and a user configurable sample window.

12. The method in claim 7, wherein the step of establishing further comprises a size of said patch testing area that is user-adjustable.

13. The method in claim 7, wherein the step of establishing further comprises said patch testing area being bounded by a beginning patch trigger point and user configurable sample window parameters.

14. The method in claim 13, further comprising the step of recording said beginning patch trigger point and said patch trigger count for future testing of said printer.

15. A method of testing a process control patch in an electrophotographic printer, said method comprising:

observing a beginning location of a reference point on a transportation device;

tracking a position of said reference point within said printer, based on said beginning location and a counter;

printing said process control patch on said transportation device in a position relative to said reference point;

identifying positions of said transportation device when said process control patch passes by a sensor;

establishing a patch testing area bound by a beginning patch trigger point and user configurable sample window parameters, wherein a difference between a leading edge and a trailing edge of said patch represents a width of said process control patch, and wherein said patch testing area is smaller than said width of said process control patch; and evaluating a printing density of said patch testing area using said sensor.

16. The method in claim 15, wherein the step of tracking bases said position of said reference point upon a difference between said beginning location and a count on said counter that is started upon the generation of said lead edge signal.

17. The method in claim 15, wherein the step of establishing further comprises said patch testing area omits testing points of said process control patch that are outside of said patch testing area determined by said patch trigger point and patch testing area size.

18. The method in claim 15, wherein the step of establishing further comprises a size of said patch testing area is user-adjustable.

19. The method in claim 15, further comprising the step of recording said beginning patch trigger point and said patch trigger count.

* * * * *